US010433603B2

(12) United States Patent
Rivera et al.

(10) Patent No.: US 10,433,603 B2
(45) Date of Patent: Oct. 8, 2019

(54) STEM EXTENSION FOR ARTIFICIAL FLOWERS

(71) Applicants: Rosie Rivera, Big Spring, TX (US); Robert Rivera, Big Spring, TX (US)

(72) Inventors: Rosie Rivera, Big Spring, TX (US); Robert Rivera, Big Spring, TX (US)

( * ) Notice: Subject to any disclaimer, the term of this patent is extended or adjusted under 35 U.S.C. 154(b) by 680 days.

(21) Appl. No.: 14/624,572

(22) Filed: Feb. 17, 2015

(65) Prior Publication Data

US 2015/0157076 A1 Jun. 11, 2015

Related U.S. Application Data

(63) Continuation-in-part of application No. 29/517,763, filed on Feb. 16, 2015, now Pat. No. Des. 767,443, and a continuation-in-part of application No. 13/551,988, filed on Jul. 18, 2012, now abandoned.

(51) Int. Cl.

| | |
|---|---|
| ***A41G 1/00*** | (2006.01) |
| ***B44C 5/06*** | (2006.01) |
| ***A47G 7/00*** | (2006.01) |
| *A47G 7/06* | (2006.01) |
| *B44C 3/00* | (2006.01) |

(52) U.S. Cl.

CPC ..... *A41G 1/00* (2013.01); *A47G 7/00* (2013.01); *B44C 5/06* (2013.01); *A47G 7/06* (2013.01); *B44C 3/00* (2013.01)

(58) Field of Classification Search

CPC .. A47G 7/00; A47G 7/06; B44C 53/00; B44C 5/06

USPC ..... 47/41.01, 41.11, 41.12, 41.13, 41.15

See application file for complete search history.

(56) References Cited

U.S. PATENT DOCUMENTS

| | | | | |
|---|---|---|---|---|
| 240,677 A | 4/1881 | Durnell | | |
| 290,811 A | 12/1883 | Streat | | |
| 2,155,106 A * | 4/1939 | Turnbull | ..... | A23G 9/506 426/139 |
| 4,072,330 A * | 2/1978 | Brysch | ..... | B01L 3/0217 285/239 |

(Continued)

OTHER PUBLICATIONS

LazyDaisy, "Red Solo Cup . . . " 2012, p. 1-4; Accessed on Dec. 21, 2017 at http://lazydaisyflowers.com/red-solo-cup/.*

*Primary Examiner* — Mark Ruthkosky
*Assistant Examiner* — Julia L Rummel
(74) *Attorney, Agent, or Firm* — Shannon Warren

(57) ABSTRACT

A stem extension for artificial flowers comprising a stem extension having an elongated shaft. The elongated shaft having a first end and a second end. The first end of the elongated shaft provided with a graduated female opening. The second end of the elongated shaft provided with a graduated male end. The stem extension comprises an exterior surface. A portion of the exterior surface comprises a course textured finish. The elongated shaft of the stem extension further comprises a one or more fins and veins arranged between the first end and the second end. The graduated male end comprises a one or more external diameters each separated from one another by a male shoulder. The graduated female receiving opening comprises a one or more internal diameters each separated from one another by a female shoulder. The graduated female opening comprises a first inside diameter and a second inside diameter.

12 Claims, 7 Drawing Sheets

(56) References Cited

U.S. PATENT DOCUMENTS

| | | | | |
|---|---|---|---|---|
| 4,111,303 | A * | 9/1978 | Compton | B65D 1/265 206/217 |
| 4,292,997 | A | 10/1981 | Bernat | |
| 4,295,664 | A | 10/1981 | Cutting | |
| 4,710,053 | A | 12/1987 | Kulp et al. | |
| 5,497,577 | A | 3/1996 | Carpenter | |
| 5,683,762 | A | 11/1997 | Banschick | |
| 6,029,937 | A | 2/2000 | Funaro | |
| 6,263,614 | B1 | 7/2001 | Koo | |
| 6,830,733 | B2 | 12/2004 | Stanley, III | |
| 2005/0025568 | A1 | 2/2005 | Mettler et al. | |
| 2005/0255005 | A1 | 11/2005 | Motadel | |
| 2006/0172433 | A1 | 8/2006 | Motadel | |
| 2007/0037927 | A1 * | 2/2007 | Yang | C08F 287/00 525/88 |

* cited by examiner

STEM EXTENSION FOR ARTIFICIAL FLOWERS

CROSS-REFERENCE TO RELATED APPLICATIONS

This application claims benefit of U.S. patent application Ser. No. 13/551,988 (filed on Jul. 18, 2012) and U.S. patent Design application No. 29/517,763 (filed Feb. 16, 2015), which are co-pending at the time of this application. Note that the filing date of this application is Feb. 17, 2015, which is the first day the USPTO is open after the weekend and Presidents Day. Accordingly, any deadlines relative to the parent applications which fell on the preceding weekend are extended through the current filing date.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

This disclosure relates generally to a Stem Extension for Artificial Flowers. Examples of similar disclosures can be found at U.S. Pat. Nos. 4,292,997, 4,295,664, 5,497,577, 5,683,762, 6,029,937, 6,263,614, 6,830,733, US 20050255005, U.S. Pat. No. 4,710,053, US 20050025568, U.S. Pat. Nos. 2,908,112, 2,406,777, and US 2006/0172433. However, none of the known inventions and patents, taken either singularly or in combination, is seen to describe the instant disclosure as claimed. Accordingly, an improved Stem Extension for Artificial Flowers would be advantageous.

The present invention is a stem extender that can be used with artificial flowers to quickly extend the length of the stem of the artificial flowers. The stem of the artificial flowers is inserted into an opening on the stem extender to lengthen the stem, and a second stem extender can be added to the first one to further lengthen the stem of an artificial flower if desired.

RELATED ART

In creating a flower arrangement with artificial flowers, it is necessary to lengthen some or all of the stems of the artificial flowers employed in order to achieve the arrangement desired. The current method for extending the length of a stem of an artificial flower or the stem of a unitary bunch of flowers is to tape or wire an extension or stake to the end of the existing stem of the flower or bunch of flower.

Adding an extension onto the existing stem of a flower with tape or wire is a time consuming and frustrating task that can result in injuries to the person attempting to lengthen the stem. If tape is used, the tape is sticky and is hard to handle, often sticking to the flowers or other unwanted surfaces. If wire is employed, the wire can prick the fingers of the person who is attempting to lengthen the stem.

The present invention addresses this problem by providing an extension that secures to the end of the stem of an artificial flower simply by pushing the end of the stem into a female receiving opening provided in the extension. If desired, the stem can then be further lengthened by pushing the opposite end of the first extension into the female receiving opening provided in a second extension. No tape or wires are required to secure the stem to the extension or to secure one extension to another.

BRIEF SUMMARY OF THE INVENTION

Two systems and a method are disclosed.

The two systems comprising a stem extension. Said stem extension for artificial flowers comprising a stem extension having an elongated shaft. Said elongated shaft having a first end and a second end. Said first end of said elongated shaft provided with a graduated female opening. Said second end of said elongated shaft provided with a graduated male end. Said stem extension comprises an exterior surface. A portion of said exterior surface comprises a course textured finish. Said elongated shaft of said stem extension further comprises a one or more fins and veins arranged between said first end and said second end. Said graduated male end comprises a one or more external diameters each separated from one another by a male shoulder. Said graduated female receiving opening comprises a one or more internal diameters each separated from one another by a female shoulder. Said graduated female opening comprises, at least, a first inside diameter and a second inside diameter. Said first inside diameter arranged proximate to said first end of said stem extension. Said first inside diameter being larger than said second inside diameter.

A method of adjusting an artificial flower arrangement comprising: positioning a one or more stem extensions in a decorating medium, and attaching a one or more artificial flowers to said one or more stem extensions. Said one or more stem extensions each comprise a stem extension having an elongated shaft. Said elongated shaft having a first end and a second end. Said first end of said elongated shaft provided with a graduated female opening. Said second end of said elongated shaft provided with a graduated male end. Said stem extension comprises an exterior surface. A portion of said exterior surface comprises a course textured finish. Said elongated shaft of said stem extension further comprises a one or more fins and veins arranged between said first end and said second end. Said graduated male end comprises a one or more external diameters each separated from one another by a male shoulder. Said graduated female receiving opening comprises a one or more internal diameters each separated from one another by a female shoulder. Said graduated female opening comprises, at least, a first inside diameter and a second inside diameter. Said first inside diameter arranged proximate to said first end of said stem extension. Said first inside diameter being larger than said second inside diameter.

DETAILED DESCRIPTION OF THE INVENTION

Described herein is a Stem Extension for Artificial Flowers. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
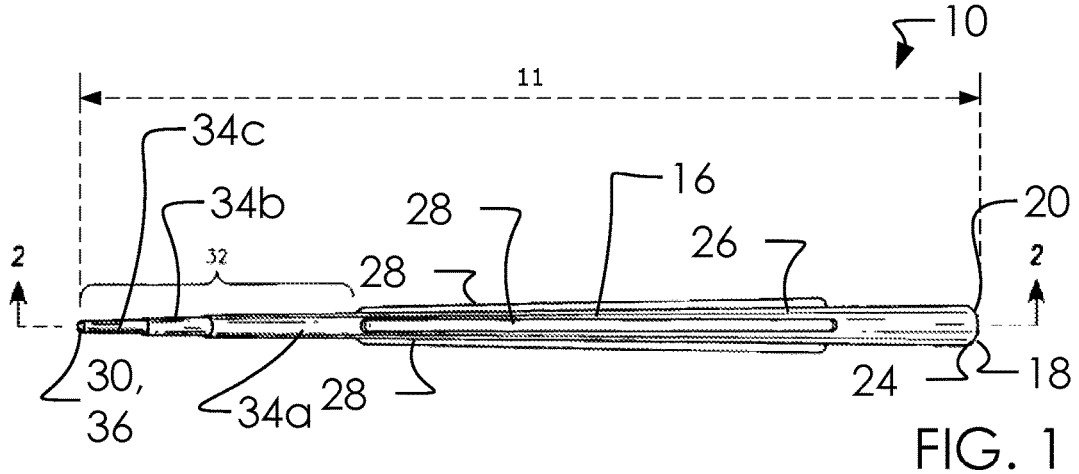
FIG. 1 is a perspective view of a stem extension 10 constructed in accordance with a preferred embodiment of the present invention.

FIG. 1 is a perspective view of a stem extension 10 constructed in accordance with a preferred embodiment of the present invention.

In one embodiment, a stem extension 10 can comprise an elongated shaft 16 comprising a graduated female opening 18 on a first end 20 of said elongated shaft 16. In one embodiment, said graduated female opening 18 can receive and secure a stem 12 (such as a first stem 12*a*, a second stem 12*b* and a third stem 12*c*) of an artificial flower 14 (such as a first artificial flower 14*a*, a second artificial flower 14*b* and a third artificial flower 14*c*). In one embodiment, said stem extension 10 can comprise a variety of a shaft length 11, but the most length of said shaft length 11 can comprise 6-8 inches.

In one embodiment, said stem extension 10 can comprise a polymer material. In another embodiment, said stem extension 10 can comprise said polymer material and an alloy of 30-50% olefin resin with the remaining material comprising ABS resins. In one embodiment, said stem extension 10 bends to a shape and holds that shape due to its material composition.

Figure 2:
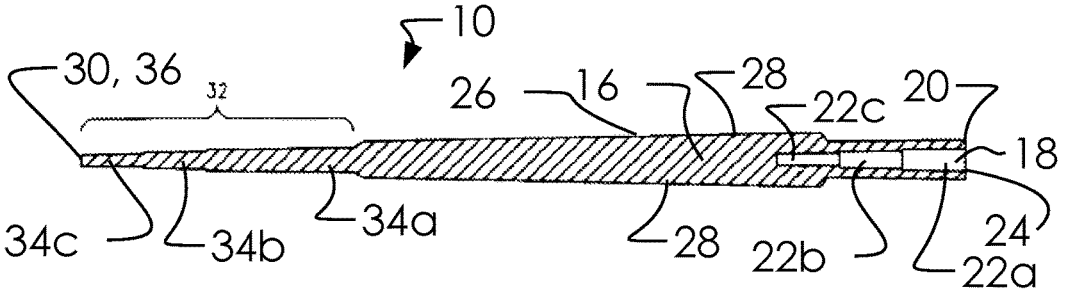
FIG. 2 is a cut away view of the stem extension of FIG. 1.

FIG. 2 is a cut away view of the stem extension of FIG. 1.

In one embodiment, said graduated female opening 18 can be graduated or tapered, comprising a first inside diameter 22*a*, a second inside diameter 22*b* and a third inside diameter 22*c*. Accordingly, a variety of stem diameters can be accommodated within said graduated female opening 18. In one embodiment, the most common diameters for a plurality of inside diameters 22 can comprise a ½ inch, 3/16 inch, and ⅛ inch; however, said stem extension 10 can be constructed to accommodate diameters of said stem 12 in any size range. In one embodiment, said first inside diameter 22*a* can comprise the largest diameter of said graduated female opening 18 and can be located adjacent to a mouth 24 of said graduated female opening 18, with the diameters of the said deeper they are located within said graduated female opening 18. In one embodiment, said graduated female opening 18 can comprise a plurality of stepped cylindrical apertures.

Figure 3:
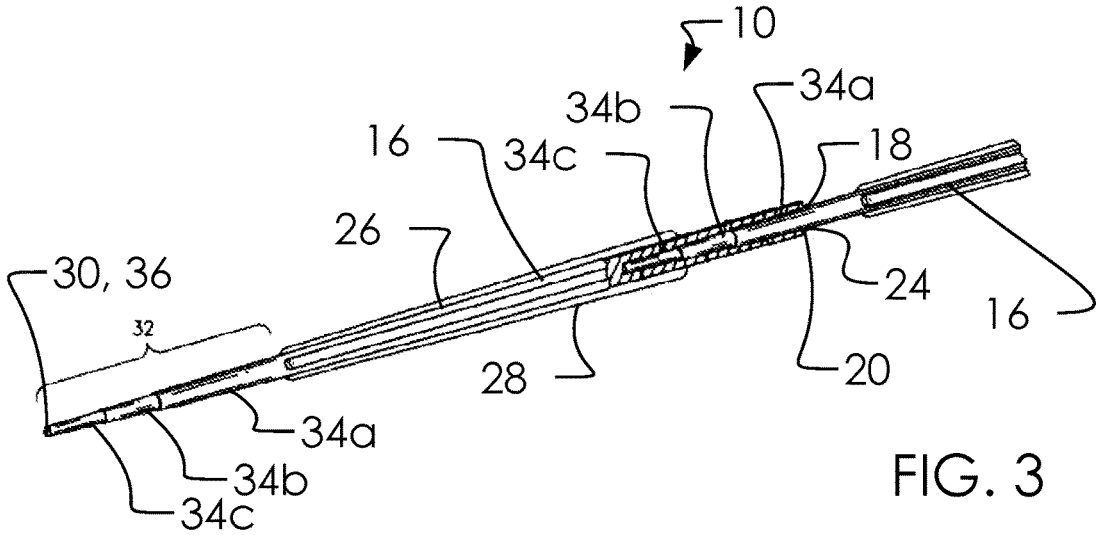
FIG. 3 is a cut away view of the stem extension of FIG. 1 to which a second stem extension has been attached.

FIG. 3 is a cut away view of the stem extension of FIG. 1 to which a second stem extension 10*b* has been attached.

In one embodiment, said stem extension 10 can comprise a second end 30. In one embodiment, said second end 30 can comprise a graduated male end 32 that is graduated or tapered having a first outside diameter 34*a*, a second outside diameter 34*b* and a third outside diameter 34*c*. Accordingly, in one embodiment, said second end 30 can be inserted into said graduated female opening 18 of said second stem extension 10*b* in order to further increase the effective length of said first artificial flower 14*a*, said second artificial flower 14*b* and said third artificial flower 14*c*. The most common outside diameters at said second end 30 can comprise ½ inch, 3/16 inch, and ⅛ inch, but the invention is not so limited. In one embodiment, the smallest diameter being said third outside diameter 34*c* can be at a tip 36 at said second end 30 and said second outside diameter 34*b* and said first outside diameter 34*a* becoming increasing larger the further they are located from said tip 36. Thus, in one embodiment said second end 30 can comprise graduated outside diameters and therefore comprise a pointed configuration that can more easily be inserted into the ground, floral foam, or other desired substance to which it is desired to attach the artificial flower.

In one embodiment, said stem extension 10 can be cut so as to remove a portion of said second end 30 and thereby shorten a combined length 72 of a first stem extension 10*a* and said second stem extension 10*b*.

Figures 4A, 4B, 4C:
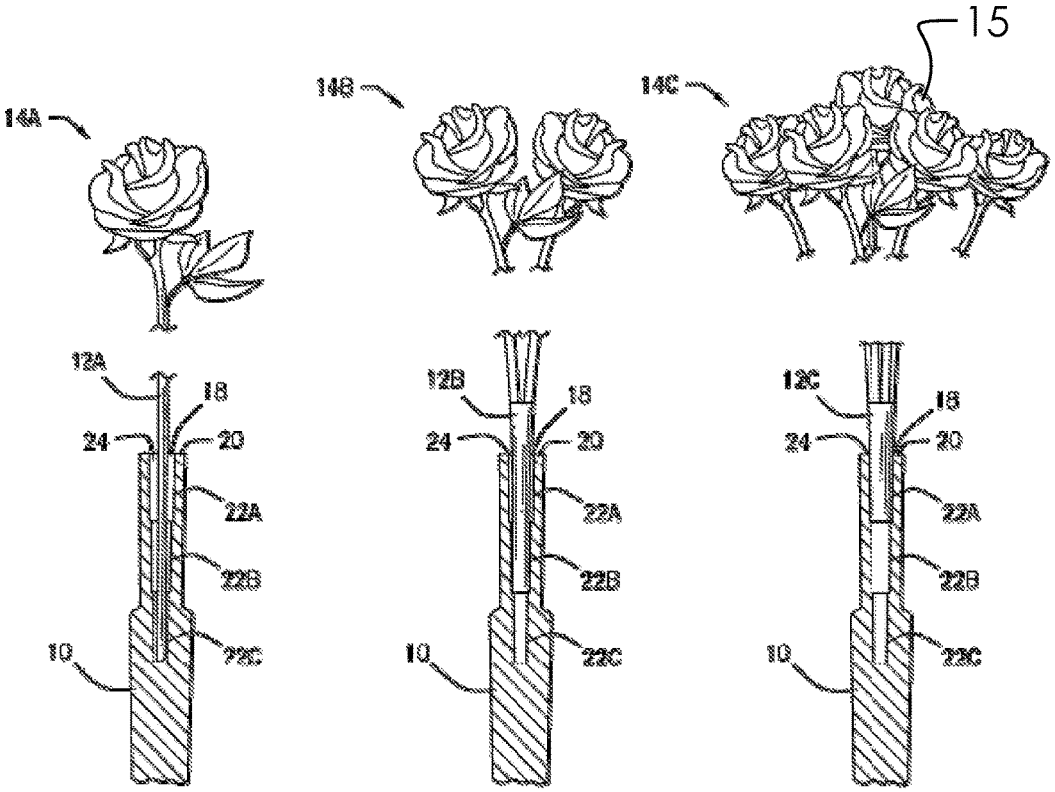
FIG. 4A is a perspective view of the stem extension of FIG. 1 shown attached to a stem of a flower.
FIG. 4B is a perspective view of the stem extension of FIG. 1 shown attached to a stem of a multiple flower.
FIG. 4C is a perspective view of the stem extension of FIG. 1 shown attached to a stem of a bunch of flowers.

FIGS. 4A, 4B and 4C illustrate a perspective view of said stem extension 10 receiving a portion of said first artificial flower 14*a*, said second artificial flower 14*b* and said third artificial flower 14*c*, respectively.

Said third artificial flower 14*c* can comprise a bunch of flowers 15.

In one embodiment, said stem extension 10 can be employed for extending the effective length of said artificial flower 14 (said first artificial flower 14*a*, said second artificial flower 14*b* and said third artificial flower 14*c*, as illustrated). In one embodiment, said second stem 12*b* and said third stem 12*c* can comprise a single or a plurality of said artificial flower 14. In one embodiment, said artificial flowers and/or said one or more bunches of artificial flowers can comprise as a variety of stem diameters which said stem extension 10 can accommodate.

Figure 5A:
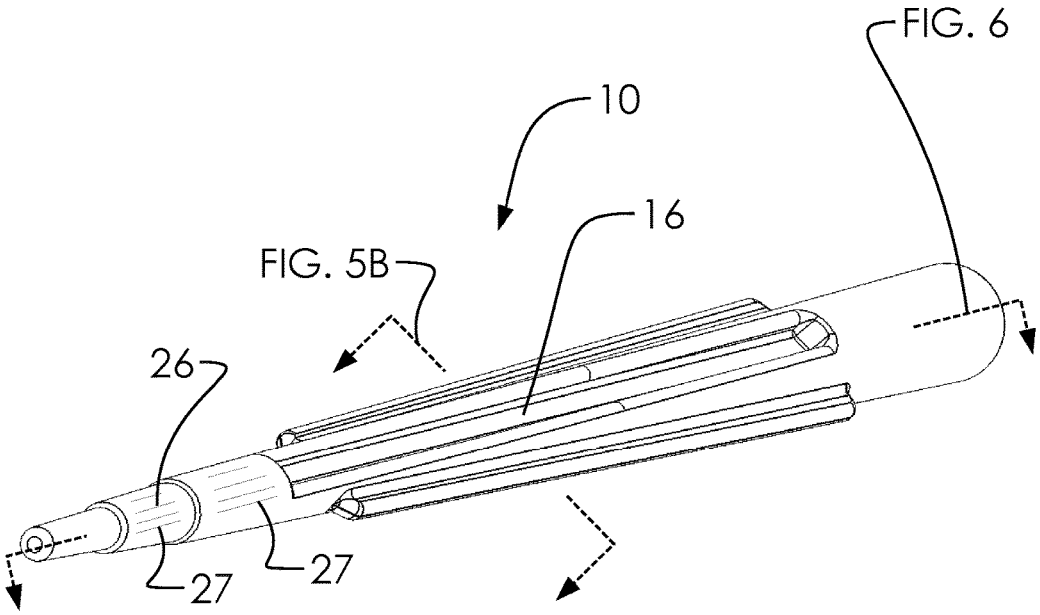
FIGS. 5A and 5B illustrate a perspective overview and a cross-section of said stem extension 10.
Figure 5B:
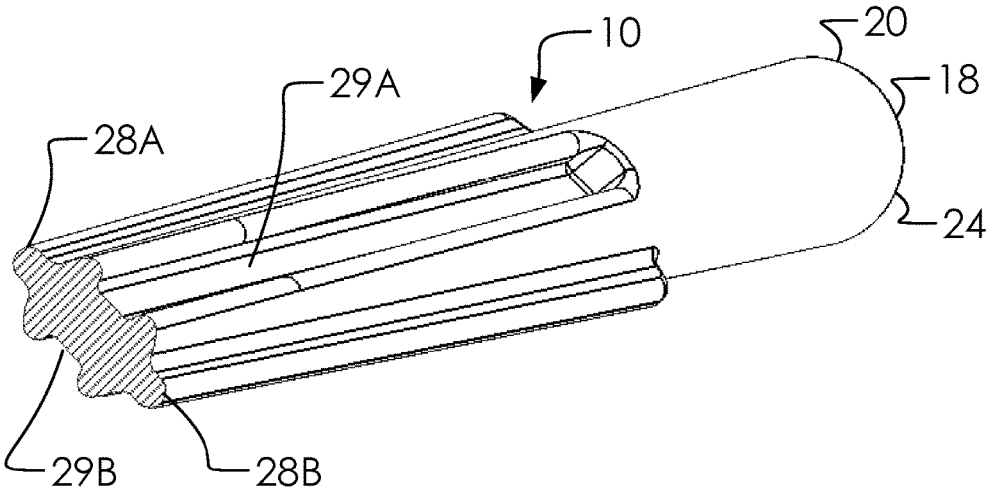

FIGS. 5A and 5B illustrate a perspective overview and a cross-section of said stem extension 10.

In one embodiment, said stem extension 10 can comprise an exterior surface 26. In one embodiment, said exterior surface 26 can comprise a course textured finish 27 which can comprise a one or more cross-axial linear sections or a one or more contoured indentations of raised sections. In one embodiment, said course textured finish 27 can aid in the sustained location of said stem extension 10 in materials such as foams, clays and/or plaster.

In one embodiment, said stem extension 10 can comprise one or more fins and veins 28. In one embodiment, said one or more fins and veins 28 can stabilize said stem extension 10 when it is inserted into the ground, into floral foam, or into another structure. In one embodiment, said stem extension 10 can comprise a four of said one or more fins and veins 28 comprising a first fin 28*a*, a second fin 28*b*, a first vein 29*a* and a second vein 29*b*. In one embodiment, said one or more fins and veins 28 extend from said elongated shaft 16, as illustrated. In one embodiment, said one or more fins and veins 28 are arranged at right angles to one another around said elongated shaft 16. However, the number of said one or more fins and veins 28 that are provided on said elongated shaft 16 is not critical to the operation of said stem extension 10.

In one embodiment, said fins can comprise a portion of said elongated shaft 16 budging out like a wing and said veins can comprise a portion indented into said elongated shaft 16. In one embodiment, said one or more fins and veins 28 can be arranged between said first end 20 and said second end 30.

In one embodiment, said course textured finish 27 can comprise a finger print like pattern or texture which moves freely in clay and foams (such as are commonly used with said first artificial flower 14*a*) but which tend to maintain a sustained location relative thereto.

In one embodiment, said one or more internal diameters of said graduated female opening 18 comprise inside diameters of ¼ inch, 3⁄16 inch, and ⅛ inch.

Figure 6:
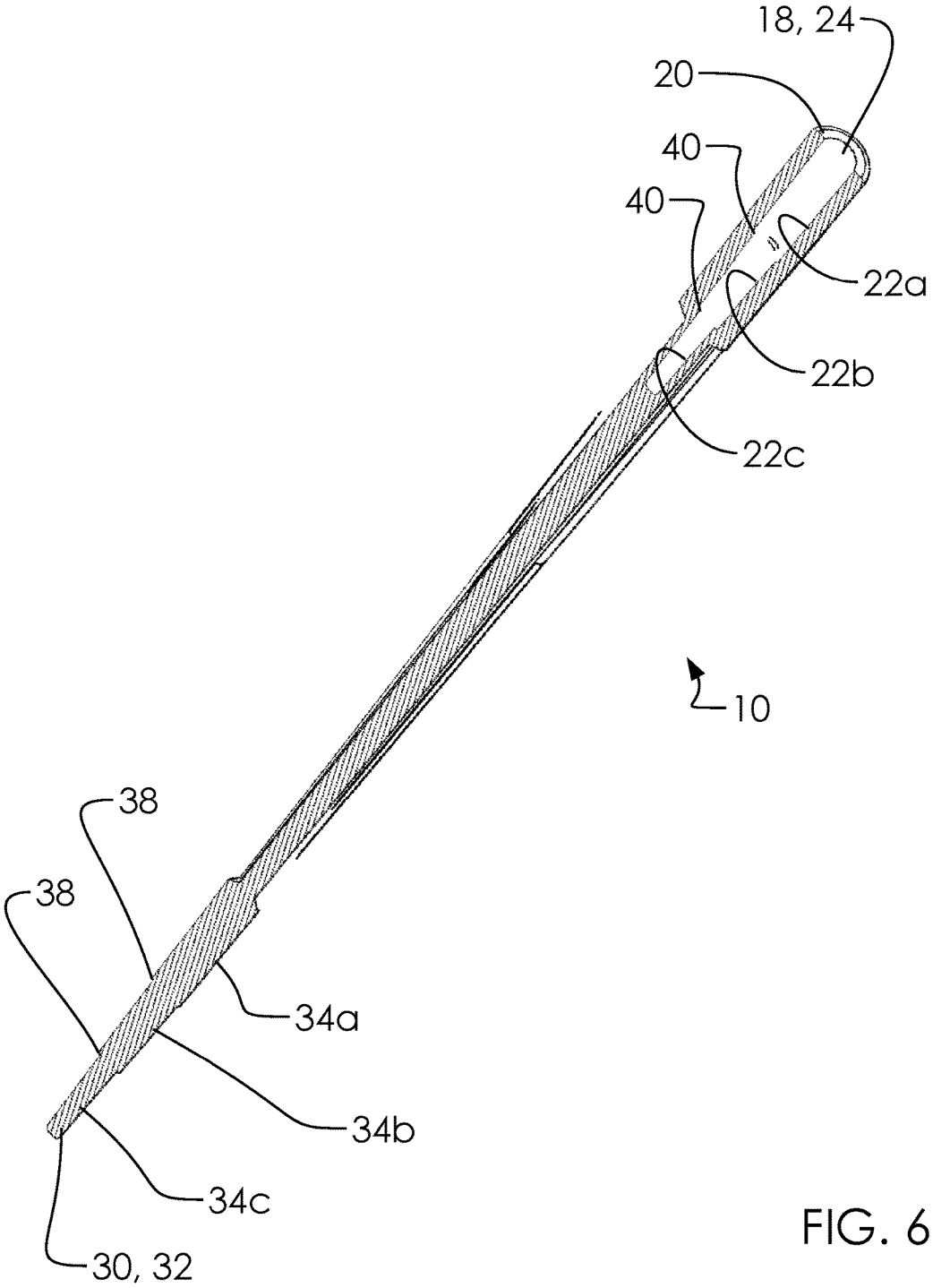
FIG. 6 illustrates cross-section perspective overview of said stem extension 10.

FIG. 6 illustrates cross-section perspective overview of said stem extension 10.

In one embodiment, said graduated male end 32 comprises a plurality of outside diameters 34 (such as said first outside diameter 34*a*, said second outside diameter 34*b* and said third outside diameter 34*c*) each separated from one another by a male shoulder 38. Likewise, in one embodiment, said graduated female opening 18 can comprise said plurality of inside diameters 22 (such as said first inside diameter 22*a*, said second inside diameter 22*b* and said third inside diameter 22*c*) each separated from one another by a female shoulder 40.

Figure 7A:
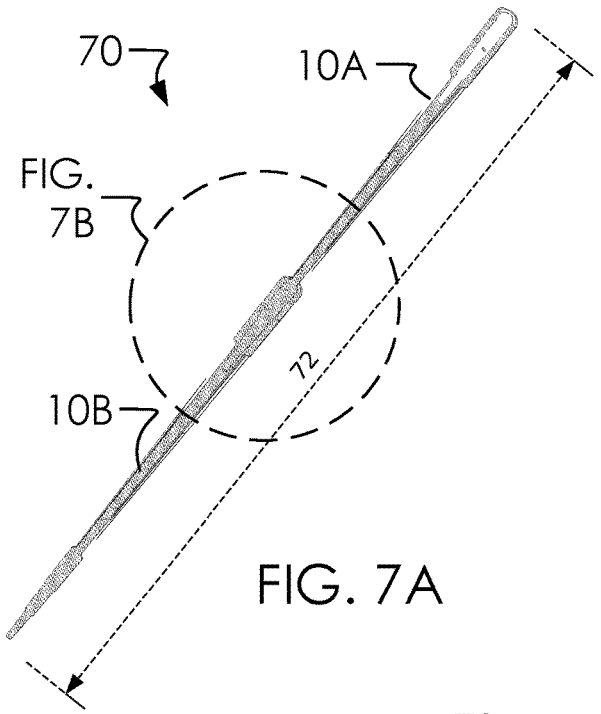
FIGS. 7A and 7B illustrate an overview and detailed a cross-section perspective view of a plurality of stem extension 70.
Figure 7B:
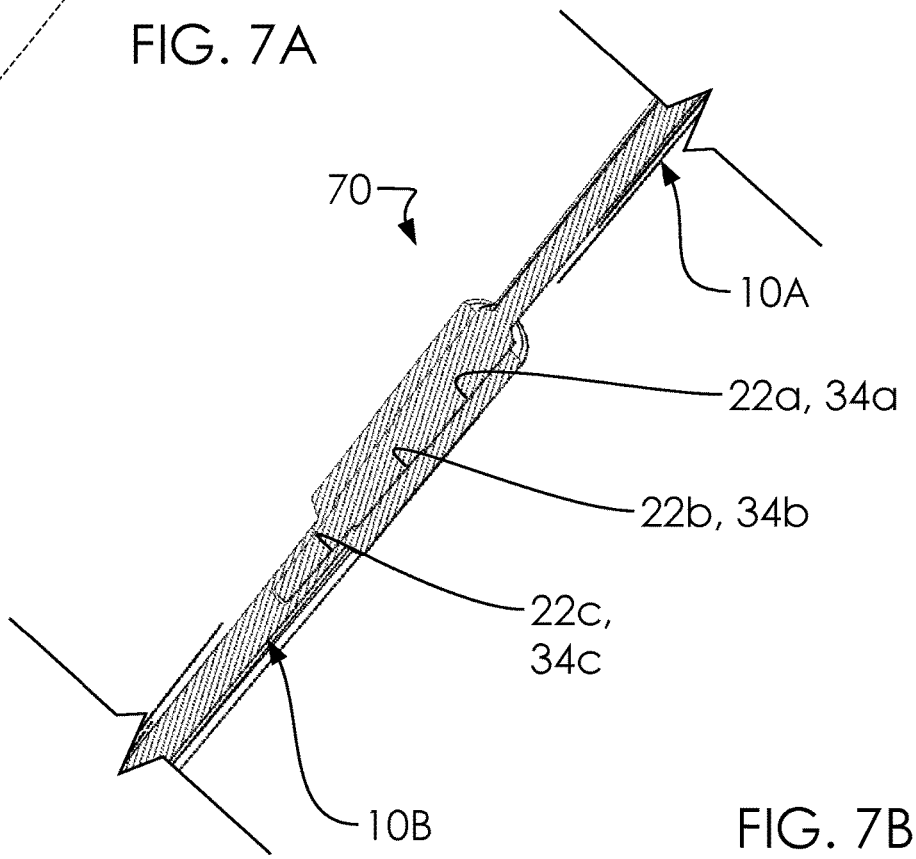

FIGS. 7A and 7B illustrate an overview and detailed a cross-section perspective view of a plurality of stem extension 70.

In one embodiment, said plurality of stem extension 70 can comprise a plurality of said stem extension 10. In one embodiment, said plurality of stem extension 70 can comprise said first stem extension 10*a*, said second stem extension 10*b* and said stem 12. In one embodiment, said plurality of outside diameters 34 (said first outside diameter 34*a*, said second outside diameter 34*b* and said third outside diameter 34*c*) at said second end 30 can be sized so as to be received by said plurality of inside diameters 22 (said first inside diameter 22*a*, said second inside diameter 22*b* and said third inside diameter 22*c*) at said graduated female opening 18. In one embodiment, said plurality of stem extension 70 can comprise said combined length 72; wherein, said combined length 72 can be altered by adding and/or removing said stem extension 10 from said plurality of stem extension 70 and/or by cutting a portion of one or more of said plurality of stem extension 70.

Figure 8A:
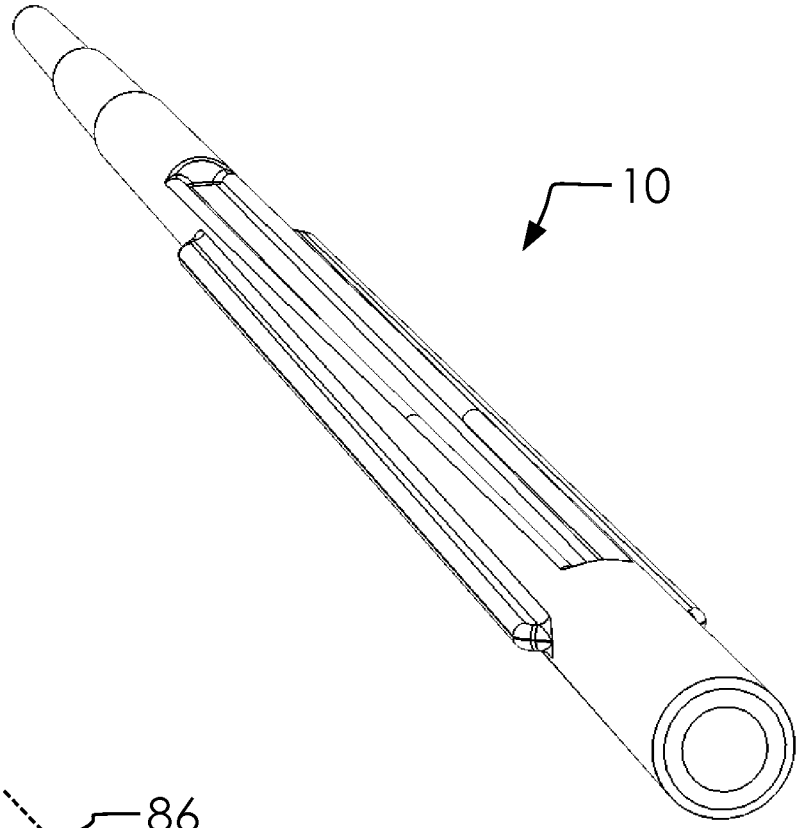
FIGS. 8A and 8B illustrate a perspective view and a cross-section perspective overview of said stem extension 10.
Figure 8B:
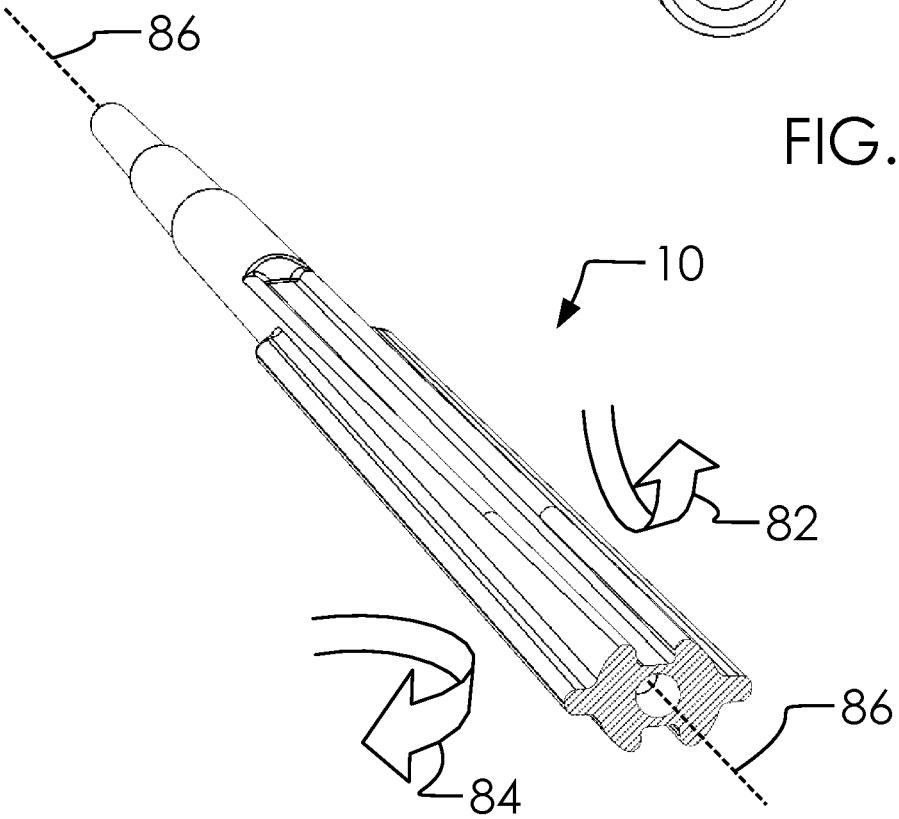

FIGS. 8A and 8B illustrate a perspective view and a cross-section perspective overview of said stem extension 10.

In one embodiment, said stem extension 10 can comprise a bending direction 82 and a non-bending direction 84. In one embodiment, said bending direction 82 can comprise bending said stem extension 10 parallel with said first vein 29*a* and said second vein 29*b* relative to a central axis 86. Likewise, in one embodiment, said non-bending direction 84 can comprise bending said stem extension 10 parallel with said first fin 28*a* and/or said second fin 28*b*, as illustrated. Accordingly, said stem extension 10 can allow its user to position and direct flexure of said first artificial flower 14*a*.

Figure 9:
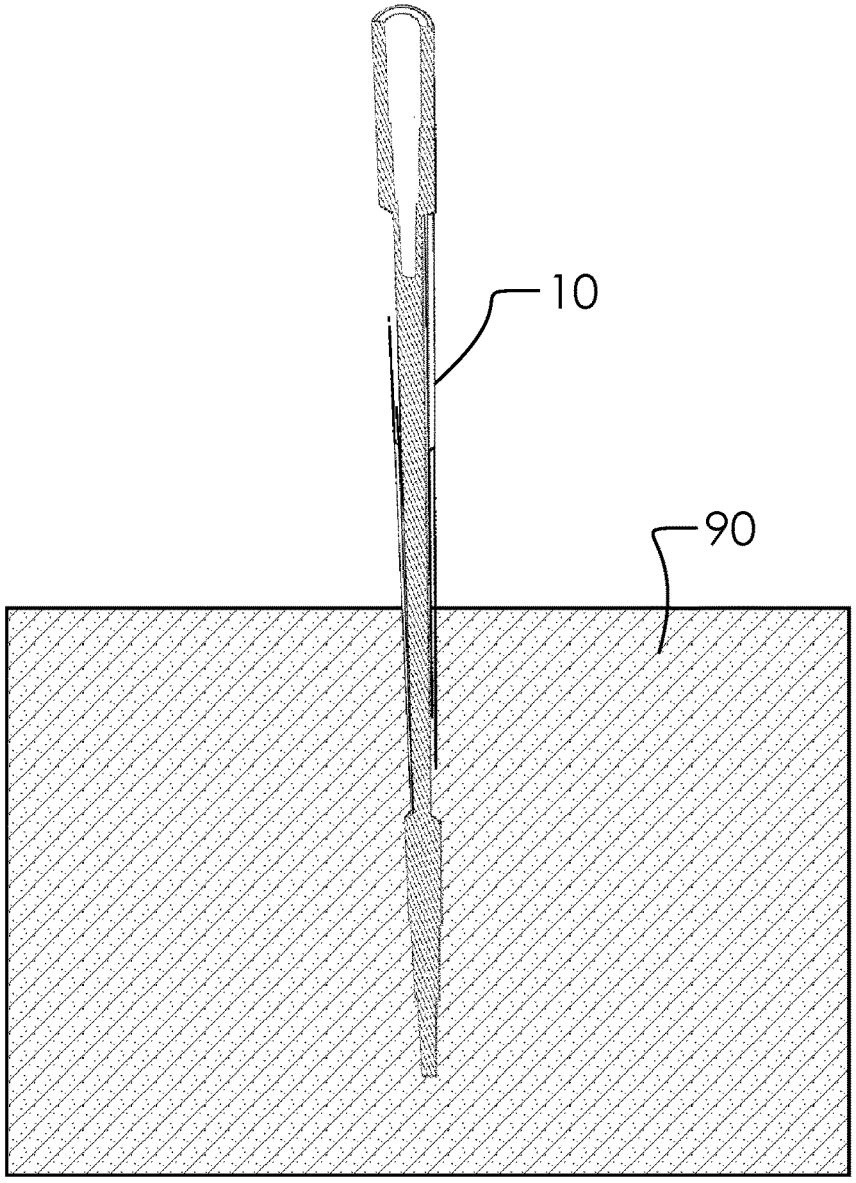
FIG. 9 illustrates an elevated front view of a cross-section of said stem extension 10 in a decorating medium 90.

FIG. 9 illustrates an elevated front view of a cross-section of said stem extension 10 in a decorating medium 90.

In one embodiment, said decorating medium 90 can comprise materials such as foams, clays and/or plaster, the ground, floral foam, or other desired substance to which it is desired to attach the artificial flower.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A stem extension for artificial flowers comprising:

a stem extension having an elongated shaft;

said elongated shaft having a first end and a second end and extending along a center axis aligned between said first end and said second end;

said first end of said elongated shaft provided with a graduated female opening extending only partially into said elongated shaft along the center axis;

said second end of said elongated shaft provided with a graduated male end that is spaced apart from the graduated female opening along the elongated shaft's center axis;

said stem extension comprising an exterior surface, a portion of said exterior surface comprising a course textured finish;

said elongated shaft further comprising two or more fins and two or more veins arranged between said first end and said second end;

said graduated male end comprising a plurality of external diameters each separated from one another by a male shoulder;

said plurality of external diameters comprising at least a first outside diameter and a second outside diameter, wherein said first outside diameter is arranged proximate to said second end of said stem extension and is smaller than said second outside diameter;

said graduated female opening comprising a plurality of internal diameters each separated from one another by a female shoulder;

said plurality of internal diameters comprising, at least, a first inside diameter, a second inside diameter, and a third inside diameter, said first inside diameter is arranged proximate to said first end of said stem extension;

said plurality of internal diameters of said graduated female opening comprising inside diameters of ¼ inches, 3/16 inches, and ⅛ inches, wherein said first inside diameter is the largest inside diameter and is located at a mouth of said graduated female opening, with each subsequent inside diameter extending further into the elongated shaft being smaller so that said graduated female opening gradually narrows to receive stems of artificial flowers within a range of stem diameters or to receive an article or portion of an article having the same shape and dimensions as the male end;

said course textured finish comprising one or more contoured indentations or raised sections and aiding in the sustained location of said stem extension in a decorating medium;

said two or more fins and said two or more veins comprising, at least, a first fin, a second fin, a first vein and a second vein; said two or more fins and said two or more veins provided externally on said elongated shaft, situated radially around the center axis of said elongated shaft at approximately right angles to each other, and extending along the length of said elongated shaft parallel to the center axis such that said two or more fins and said two or more veins stabilize said stem extension when it is inserted into a decorating medium.

2. Said stem extension of claim 1, wherein:

said stem extension comprises a shaft length of 6-8 inches.

3. Said stem extension of claim 1, wherein:

said stem extension is molded from a polymer material.

4. Said stem extension of claim 1, wherein:

said stem extension is molded from polymer material and an alloy of 30-50% olefin resin with the remaining material comprising ABS resins.

5. Said stem extension of claim 1, wherein:

said stem extension is a first stem extension and said article is a second stem extension and said first stem extension and said second stem extension comprise a material suitable for cutting in order to reduce a combined length of said first stem extension and said second stem extension to a desired length.

6. Said stem extension of claim 1, wherein:

said graduated male end comprises a plurality of outside diameters;

said plurality of outside diameters comprise outside diameters at said second end comprising a first outside diameter being ⅛ inch, a second outside diameter being 3/16 inch, and a third outside diameter being ½ inch; and said first outside diameter is nearest said tip and said third outside diameter furthest from said tip.

7. Said stem extension of claim 1, wherein:

said stem extension is referred to as a first stem extension and said article is referred to as a second stem extension and said first stem extension is configured to receive a portion of a second stem extension; said mouth of said first stem extension is configured to receive a portion of a male end of said second stem extension having a plurality of outside diameters, and said plurality of outside diameters of said second stem extension fit snuggly into said plurality of inside diameters of said first stem extension since said plurality of inside diameters of said first stem extension and said plurality of outside diameters of said second stem extension comprise identical diameters.

8. Said stem extension of claim 1, wherein:

said decorating medium is selected among a group of materials consisting of foams, clays and plaster.

9. Said stem extension of claim 1, further comprising:

a bending direction and a non-bending direction relative to the center axis wherein said bending direction is parallel with said first vein and said second vein relative to said center axis and said non-bending direction is parallel with said first fin and said second fin relative to said center axis.

10. A method of adjusting an artificial flower arrangement comprising:

positioning one or more stem extensions in a decorating medium, and attaching one or more artificial flowers to said one or more stem extensions; wherein, each stem extension of said one or more stem extensions comprises:

a stem extension having an elongated shaft;

said elongated shaft having a first end and a second end and extending along a center axis aligned between said first end and said second end;

said first end of said elongated shaft provided with a graduated female opening extending only partially into said elongated shaft along the center axis;

said second end of said elongated shaft provided with a graduated male end that is spaced apart from the graduated female opening along the elongated shaft's center axis;

said stem extension comprising an exterior surface, a portion of said exterior surface comprising a course textured finish;

said elongated shaft further comprising two or more fins and two or more veins arranged between said first end and said second end;

said graduated male end comprising a plurality of external diameters each separated from one another by a male shoulder;

said plurality of external diameters comprising at least a first outside diameter and a second outside diameter, wherein said first outside diameter is arranged proximate to said second end of said stem extension and is smaller than said second outside diameter;

said graduated female opening comprising a plurality of internal diameters each separated from one another by a female shoulder;

said plurality of internal diameters comprising, at least, a first inside diameter, a second inside diameter, and a third inside diameter, said first inside diameter is arranged proximate to said first end of said stem extension;

said plurality of internal diameters of said graduated female opening comprising inside diameters of ¼ inches, 3/16 inches, and ⅛ inches, wherein said first inside diameter is the largest inside diameter and is located at a mouth of said graduated female opening, with each subsequent inside diameter extending further into the elongated shaft being smaller so that said graduated female opening gradually narrows to receive stems of artificial flowers within a range of stem diameters or to receive an article or portion of an article having the same shape and dimensions as the male end;

said course textured finish comprising one or more contoured indentations or raised sections and aiding in the sustained location of said stem extension in a decorating medium;

said two or more fins and said two or more veins comprising, at least, a first fin, a second fin, a first vein, and a second vein; said two or more fins and said two or more veins provided externally on said elongated shaft, situated radially around the center axis of said elongated shaft at approximately right angles to each other, and extending along the length of said elongated shaft parallel to the center axis such that said two or more fins and said two or more veins stabilize said stem extension when it is inserted into the decorating medium.

11. The method of adjusting an artificial flower arrangement of claim 10, further comprising:

adjusting a combined length of said one or more stem extensions by attaching a plurality of stem extensions to one another to achieve said combined length, and arranging said one or more artificial flowers in said medium according to taste;

and wherein, a plurality of said stem extensions are selectively attached to one another in order to achieve said combined length, said plurality of said stem extensions can comprise, at least, a first stem extension and a second stem extension, and said graduated female opening of said first stem extension selectively receives said graduated male end of said second stem extension.

12. The method of adjusting an artificial flower arrangement of claim 10, further comprising:

adjusting a length of said one or more stem extensions by cutting and throwing away a portion of said one or more stem extensions.

* * * * *